US010779619B2

(12) United States Patent
Vongnakhone

(10) Patent No.: US 10,779,619 B2
(45) Date of Patent: Sep. 22, 2020

(54) RING SIZING INSERT

(71) Applicant: Kali Group Holdings & Co. Inc., Chilliwack (CA)

(72) Inventor: Chaleunxay Vongnakhone, Chilliwack (CA)

( * ) Notice: Subject to any disclaimer, the term of this patent is extended or adjusted under 35 U.S.C. 154(b) by 122 days.

(21) Appl. No.: 16/035,515

(22) Filed: Jul. 13, 2018

(65) Prior Publication Data

US 2019/0014871 A1 Jan. 17, 2019

Related U.S. Application Data

(60) Provisional application No. 62/532,796, filed on Jul. 14, 2017.

(51) Int. Cl.
*A44C 9/02* (2006.01)

(52) U.S. Cl.
CPC ..... *A44C 9/02* (2013.01)

(58) Field of Classification Search
CPC ..... A44C 9/02
USPC ..... 63/15.5, 15.6, 15.65
See application file for complete search history.

(56) References Cited

U.S. PATENT DOCUMENTS

| | | | | |
|---|---|---|---|---|
| 307,869 | A | 11/1884 | Place | |
| 1,115,764 | A | 11/1914 | Applas | |
| 1,327,606 | A | 1/1920 | Bacharach | |
| 1,382,043 | A | 6/1921 | Young | |
| 1,544,303 | A * | 6/1925 | Fellows | A41F 15/02 24/341 |
| 1,712,276 | A | 5/1929 | Levin | |
| 1,754,392 | A | 4/1930 | Levin | |
| 1,809,045 | A | 6/1931 | Kraft et al. | |
| 1,864,447 | A | 6/1932 | Lev | |
| 2,010,444 | A | 8/1935 | Sokolof | |
| 2,059,228 | A | 11/1936 | Granat | |
| 2,579,856 | A | 12/1951 | Pollard et al. | |
| D178,743 | S | 9/1956 | Dean Walley, III | |
| 3,017,754 | A | 1/1962 | Manne et al. | |
| 3,228,208 | A | 1/1966 | Silverman | |
| 3,236,065 | A | 2/1966 | Gladding | |
| 3,263,444 | A | 8/1966 | Di Croce | |
| 3,465,544 | A | 9/1969 | Tucker | |
| 3,518,843 | A | 7/1970 | Boening | |

(Continued)

FOREIGN PATENT DOCUMENTS

| | | |
|---|---|---|
| CA | 650768 | 10/1962 |
| CA | 848686 | 8/1970 |

(Continued)

OTHER PUBLICATIONS

Fred Klotz, Arthritic Finger Joints and Adjustable Rings, Hoover & Strong, printed online on Apr. 20, 2017.

*Primary Examiner* — Jack W Lavinder
(74) *Attorney, Agent, or Firm* — Nicholas Garner; Oyen Wiggs Green Mutala LLP

(57) ABSTRACT

There is provided a ring sizing insert. The insert includes a pair of elongate members each of which is shaped to partially extend about the opening of a ring. A first of the elongate members includes a pair of spaced-apart, outwardly extending protrusions. A second of the elongate members includes a pair of spaced-apart recesses shaped to selectively receive respective ones of the protrusions. The elongate members when coupled together form a receptacle within which a portion of the band of the ring fits.

18 Claims, 11 Drawing Sheets

(56) References Cited

U.S. PATENT DOCUMENTS

| | | | | |
|---|---|---|---|---|
| D249,878 | S | 10/1978 | Sokoloski | |
| 4,377,079 | A | 3/1983 | Krueger | |
| 4,480,447 | A | 11/1984 | Lodrini | |
| 4,538,430 | A | 9/1985 | Parks | |
| 4,569,211 | A | 2/1986 | Lodrini | |
| 5,131,243 | A | 7/1992 | Coleman | |
| 5,628,208 | A | 5/1997 | Rood | |
| 5,806,344 | A | 9/1998 | Bonchek | |
| D491,835 | S | 6/2004 | Death et al. | |
| 7,735,337 | B2 | 6/2010 | Nanasi | |
| 7,797,964 | B1 | 9/2010 | Lynch | |
| 2004/0134228 | A1 | 7/2004 | Sills | |
| 2008/0314082 | A1 * | 12/2008 | Nanasi | A44C 9/02 63/15.6 |

FOREIGN PATENT DOCUMENTS

| | | | | |
|---|---|---|---|---|
| GB | 230695 | | 3/1925 | |
| WO | WO-2005026849 | A2 * | 3/2005 | A44C 9/02 |

* cited by examiner

FIG. 10
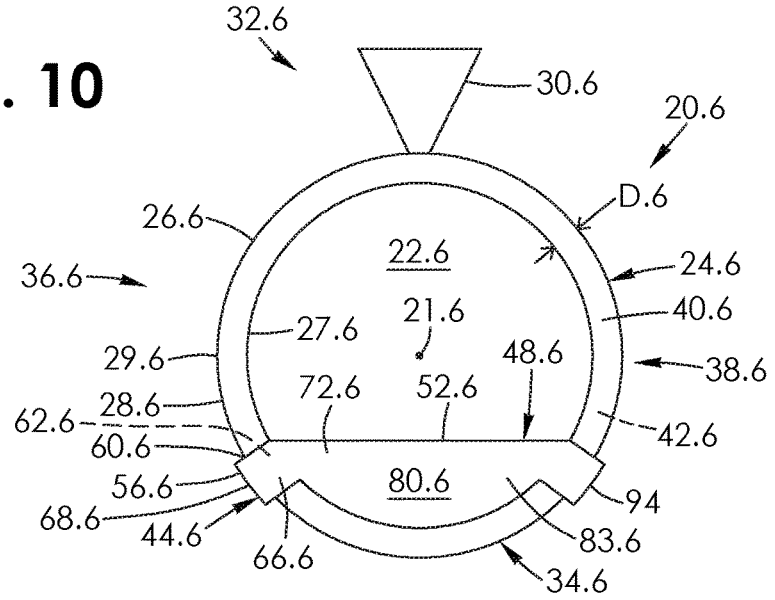
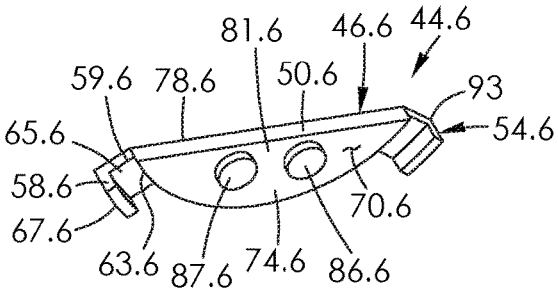
FIG. 11
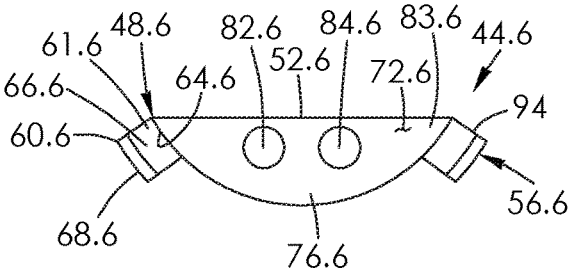
FIG. 12
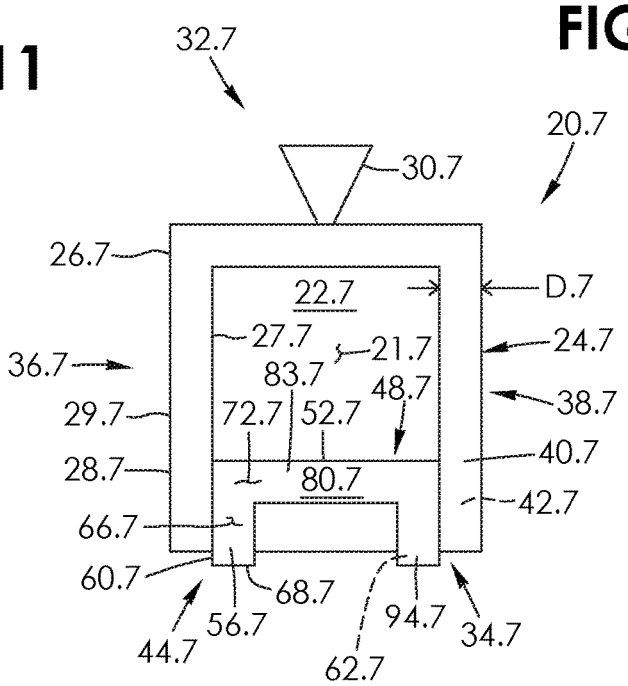
FIG. 13

RING SIZING INSERT

BACKGROUND OF THE INVENTION

Field of the Invention

There is provided an insert. In particular, there is provided a ring sizing insert for modifying and effectively reducing ring size.

Description of the Related Art

U.S. Pat. No. 5,628,208 to Rood discloses a ring reducer for fitting a larger ring to an individual's smaller finger. The reducer includes a ring having a slot allowing a portion of a ring to be positioned within the conduit. A reducing web extends inward from the conduit to reduce the area of the ring and allow for the snug fit of a larger ring over a smaller finger. The reducer may be customized to a particular individual by trimming the reducing web with a knife.

U.S. Pat. No. 3,228,208 to Silverman discloses an adjustable finger ring. The finger ring includes an upper member having a concave surface formed with guide holes and a lower member secured to the upper member. The lower member has a convex surface mating with the concave surface and is provided with a longitudinally extending groove having a wide end and a narrow end. The lower member has guide pins received in the received in the guide holes, with transversely disposed teeth formed in the groove and projecting in a direction radially outwardly thereof. The concave surface and the groove define a channel of predetermined height therebetween. The finger ring includes a split ring shank of resilient material having a narrow end portion secured to the members adjacent the wide end of the groove. The shank extends exteriorly therefrom and has its other end flattened out and forming a laterally enlarged portion provided with a radial hole. The laterally enlarged portion is wider than the maximum transverse dimension of the groove narrow end and slidably secured in the groove narrow end. The finger ring includes a ball element having a diameter slightly larger than the hole. The ball element is held seated in the hole and urged against ones of the teeth by the resilience of the shank.

U.S. Pat. No. 2,010,444 to Sokolof discloses a finger ring guard comprising a pair of relatively heavy beam parts to sustain the pressure of the ring finger exerted thereon and a pair of relatively thin sockets for receiving therein portions of a ring. The beam parts are made relatively massive in a direction transversely to the plane of the ring as well as in a direction parallel to the plane of the ring. The beam parts and sockets are integral with each other and with the guard. The guard is jointless. The beam parts and sockets have substantially the same degree of hardness.

BRIEF SUMMARY OF INVENTION

There is provided, and it is an object to provide, an improved ring sizing insert.

There is provided a ring sizing insert. The insert includes a pair of elongate members, each of which is shaped to partially extend within the opening of the ring. A first of the elongate members includes an outwardly extending protrusion. A second of the elongate members has a recess shaped to selectively receive the protrusion. The elongate members, when coupled together, form a receptacle which receives a portion of the band of the ring.

There is further provided a ring sizing insert. The insert includes a pair of elongate members, each of which is shaped to partially extend within the opening of the ring. Each of the elongate members is a circular segment in side profile. A first of the elongate members includes at least one outwardly extending protrusion. A second of the elongate members has at least one recess shaped to selectively receive the protrusion via an interference fit. The elongate members when coupled together form a receptacle within which the band of the ring extends. Each of the elongate members includes at least one catch shaped to at least partially extend about a portion of the ring. The catches are positioned radially outwards from the annular inner surface of the ring. Each catch includes a first portion which extends across the depth of the ring and a second portion which extends across part of and in the direction of the width of the ring.

There is also provided a ring sizing insert. The insert includes a pair of elongate members each of which is shaped to partially extend about the opening of the ring. A first of the elongate members includes a pair of spaced-apart, outwardly extending protrusions. A second of the elongate members has a pair of spaced-apart recesses shaped to selectively receive respective ones of the protrusions. The elongate members when coupled together form a receptacle within which the band of the ring extends.

There is yet further provided a ring sizing insert. The insert includes a first elongate member having a channel shaped to receive and extend along a portion of a first annular end of the ring. The insert includes a second elongate members having a channel shaped to receive and extend along a portion of a second annular end of the ring. The elongate members are rigid, selectively connectable together and shaped to partially extend within the opening of a ring.

There is yet also provided a ring coupler. The coupler includes a first elongate member including a channel shaped to receive and extend along a portion of an annular end of a first ring. The coupler includes a second elongate members including a channel shaped to receive and extend along a portion of an annular end of a second ring. The elongate members are rigid, selectively connectable together for coupling together the rings and shaped to partially extend within the opening of the rings.

There is additionally provided a kit of ring sizing inserts. The kit includes a first elongate member having a channel which is shaped to receive and extend along a portion of a first annular end of the ring. The kit includes a second elongate member having a channel which is shaped to receive and extend along a portion of a second annular end of the ring. The kit includes a third elongate member having a channel which is shaped to receive and extend along a portion of the second annular end of the ring. The channel of the third elongate member is deeper than the channel of the second elongate member. The first elongate member and the second elongate member are selectively connectable together and shaped to partially extend within the opening of a first ring having a width. The first elongate member and the third elongate member are selectively connectable together and shaped to partially extend within the opening of a second ring having a width that is larger than the width of the first ring.

BRIEF DESCRIPTION OF DRAWINGS

The invention will be more readily understood from the following description of preferred embodiments thereof given, by way of example only, with reference to the accompanying drawings, in which:

FIG. 10 is an end view of a ring with a ring sizing insert, the insert being according to a seventh aspect and being coupled to the ring;

FIG. 11 is an end perspective view of a first of the elongate members of the insert of FIG. 10;

FIG. 12 is an end view of a second of the elongate members of the insert of FIG. 10;

FIG. 13 is an end view of a square-shaped ring with a ring sizing insert, the insert being according to an eighth aspect and being coupled to the ring;

DESCRIPTION OF THE PREFERRED EMBODIMENTS

Figure 1:
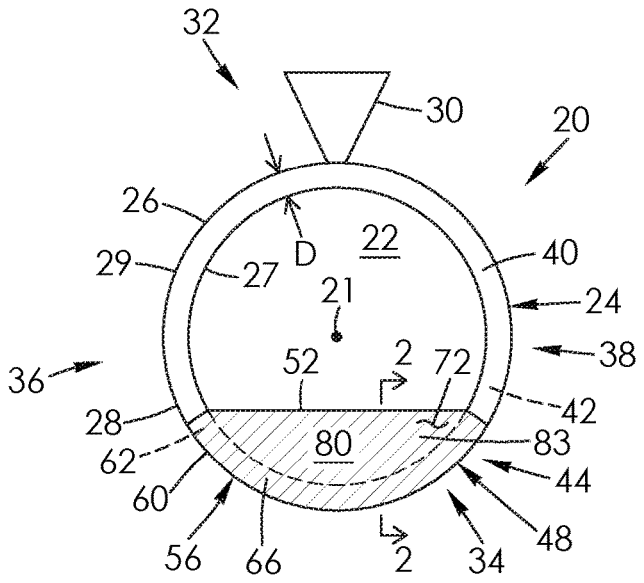
FIG. 1 is an end view of an annular ring with a ring sizing insert, the insert being according to a first aspect and being coupled to the ring.

Referring to the drawings and first to FIG. 1, there is shown a ring 20 that is annular and which extends about an axis 21. The ring has an opening 22, and includes an annular band 24 that is circular in this example and which extends about the opening. The band comprises an upper shank 26 and a lower shank 28, each of which is semi-circular in shape. The band 24 of the ring includes an inner surface, in this example an annular inner surface 27 in communication with the opening 22 and an outer surface, in this example an annular outer surface 29. The ring has a depth D which extends between the inner and outer surfaces of the band.

A precious stone 30 couples to the upper shank at a top 32 of the ring. The ring 20 has a bottom 34 spaced from the top thereof and a pair of spaced-apart sides 36 and 38 which extend between the bottom and top thereof. The ring has a first annular end 40 and a second annular end 42 spaced-apart from the first annular end. The band 24 of the ring 20 has a ring width which extends between the annular ends 40 and 42 of the ring.

Figure 2:
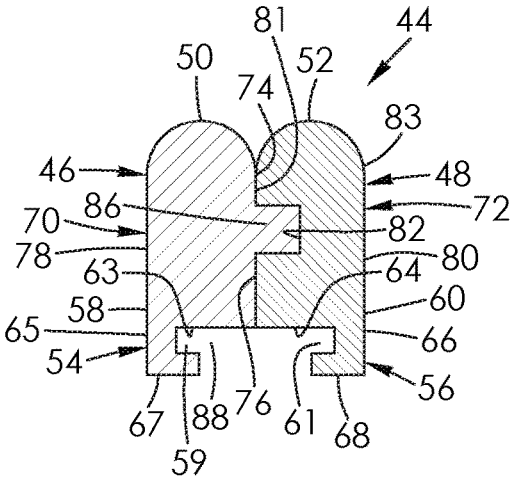
FIG. 2 is a cross-sectional view taken along lines 2-2 of the insert of FIG. 1, the insert comprising a pair of elongate members.

As seen in FIG. 1, there is provided a ring guard or ring sizing insert 44, which may also be referred to as an adapter assembly for effectively modifying the ring size of ring 20. As seen in FIG. 2, the insert includes a pair of elongate members 46 and 48. Each of the elongate members is shaped to partially extend about the opening 22 of the ring 20, as seen by elongate member 48 in FIG. 1, and extend substantially in parallel with the annular ends 40 and 42 of the ring 20. The elongate members 46 and 48 are rigid and may be made of plastic, such as clear plastic, or metal, for example, such as gold, silver, platinum or stainless steel. These types of materials are examples only and are not strictly required, and the elongate members may be made of other materials in other embodiments.

The elongate members include finger-abutting, inner peripheral edges disposed within and extending along the opening of the ring. This is seen in FIG. 1 by inner peripheral edge 52 for elongate member 48 and by inner peripheral edge 50 for elongate member 46 seen in FIG. 2. As seen in FIG. 1, the inner peripheral edges are generally straight and chord-like in lateral profile in this example and extend generally in a direction which is perpendicular to the axis 21 of the ring 20. As seen in FIG. 2, each of the inner peripheral edges 50 and 52 of the elongate members 46 and 48 is arcuate-shaped in cross-section.

The elongate members include ring-abutting, outer peripheral portions as seen in FIG. 1 by outer peripheral portion 56 for elongate member 48 and by outer peripheral portion 54 for elongate member 46 seen in FIG. 2. As seen in FIG. 1, the outer peripheral portions of the elongate members are spaced-apart from the inner peripheral edges 50 and 52 of the elongate members. Each of the outer peripheral portions 54 and 56 has a radius of curvature which is substantially similar to the radius of curvature of the annular outer surface 29 of the ring 20 seen in FIG. 1 in this example. The outer peripheral portions of the elongate members are arcuate-shaped in lateral profile in this example.

As seen in FIG. 2, the outer peripheral portions 54 and 56 of the elongate members 46 and 48 include catches 58 and 60, respectively. Each of the catches is C-shaped in cross-section in this example. The catches 58 and 60 face each other, and are shaped to at least partially extend about a portion of the band of the ring, as seen in FIG. 1 by catch 60 extending about portion 62 of band 24 of ring 20. The catches are positioned to extend outwards from the annular inner surface 27 of the ring 20 to and past the annular outer surface 29 of the ring.

Referring to FIGS. 1 and 2, catches 58 and 60 include arc-shaped, inner portions 63 and 64, respectively, shaped to abut the annular inner surface of the ring seen in FIG. 1. As seen in FIG. 2, catches 58 and 60 include arc-shaped, circumferentially-extending lateral portions 65 and 66, respectively, which extends across the depth D of the ring 20 as seen in FIG. 1. Referring to FIG. 2, catches 58 and 60 include arc-shaped outer portions 67 and 68, respectively, which extend across part of and in the direction of the width of the ring. The inner portions 63 and 64 and outer portions 67 and 68 of the catches 58 and 60 extend in parallel with each other in this example. The lateral portion 65 of the catch 58 couples to and extends between portions 63 and 67. The lateral portion 66 of the catch 60 couples to and extends between portions 64 and 68.

Figure 3:
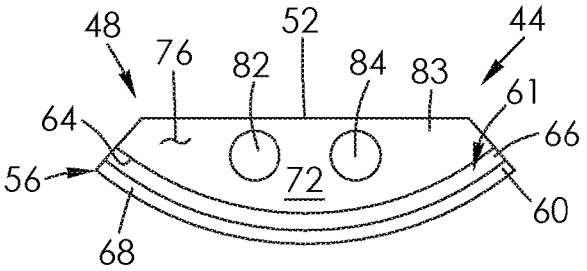
FIG. 3 is an end view of a first of the elongate members of the insert of FIG. 2.

Referring to FIG. 2, the catches 58 and 60 form and define channels 59 and 61. The channels are arc-shaped in this example, as seen in FIG. 3 by channel 61. Channel 59 is shaped to receive and extend along a portion of the first annular end 40 of band 24 of ring 20 seen in FIG. 1, and channel 61 is shaped to receive and extend along an adjacent portion of the second annular end 42 of the band of the ring.

Each of the elongate members 46 and 48 includes a laterally-extending planar portion which extends between its inner and outer peripheral portions. This is seen in FIG. 1 by planar portion 72 for elongate member 48 in FIG. 1 and planar portion 70 for elongate member 46 seen in FIG. 2. Referring to FIG. 2, inner surfaces 74 and 76 of the planar portions 70 and 72 of the elongate members 46 and 48 face each other, and outer surfaces 78 and 80 are spaced-apart from said inner surfaces 74 and 76, respectively. As seen in FIGS. 1 and 2, the planar portions of the elongate members 46 and 48 each comprise inner planar portions or regions 81 and 83, respectively. The regions are circular segments in lateral profile spanning the opening 22 of the ring 20 in this example, as seen in FIG. 1 via region 81 of planar portion 72 of elongate member 48.

Figure 4:
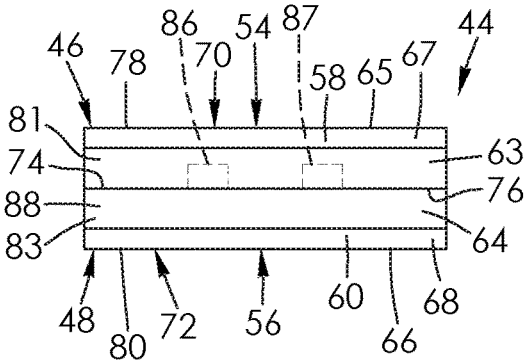
FIG. 4 is an outer side elevation view of the elongate members of the insert of FIG. 2.

As seen in FIG. 3, elongate member 48 includes at least one, and in this example a pair of recesses, in this example sockets 82 and 84 which are generally in the shape of cylindrical bores in this example. The sockets extend into the planar portion 72 thereof, from the inner surface 76 towards the outer surface 80 of the planar portion seen in FIG. 2. Referring to FIGS. 2 and 4, elongate member 46 includes at least one, and in this example a pair of outwardly extending protrusions 86 and 87. The protrusions are generally cylindrical in shape in this example. The protrusions 86 and 87 couple to and extend outwards from the inner planar portion or region 81 of elongate member 46. Sockets 82 and 84 are shaped to selectively receive the protrusions 86 and 87. In this manner, the elongate members 46 and 48 are shaped to interference fit together, with the inner surfaces 74 and 76 of the planar portions 70 and 72 of the elongate members 46 and 48 abutting each other when the elongate members are so coupled together. The elongate members are thus selectively connectable together. The peripheral portions 54 and 56 of the elongate members 46 and 48, when coupled together, form a receptacle 88 through which a portion of the band of the ring extends. In this manner and referring to FIG. 1, the insert 44 selectively couples to the ring 20. The elongate members 48 so shaped function to reduce the effective size of the opening 22 of the ring, thereby enabling the ring to fit onto a smaller-sized finger, toe or the like.

Figure 5:
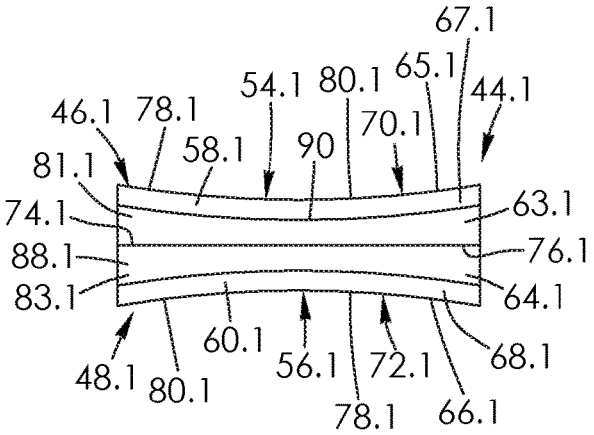
FIG. 5 is an outer side elevation view of the elongate members of a ring sizing insert according to a second aspect.

FIG. 5 shows a ring sizing insert 44.1 according to a second aspect. Like parts have like numbers and functions as the insert 44 shown in FIGS. 1 to 4 with the addition of decimal extension "0.1". Insert 44.1 is the same as described for insert 44 shown in FIGS. 1 to 4 with the following exceptions.

In this example, the outer surfaces 78.1 and 80.1 of the planar portions 70.1 and 72.1 of the elongate members 46.1 and 48.1 are outwardly concave. The catches 58.1 and 60.1 are most adjacent to each other at a central region 90 of the insert 44.1. The planar portions 70.1 and 72.1 are shaped to become gradually narrower as they extend within the opening of the ring.

Figure 6:
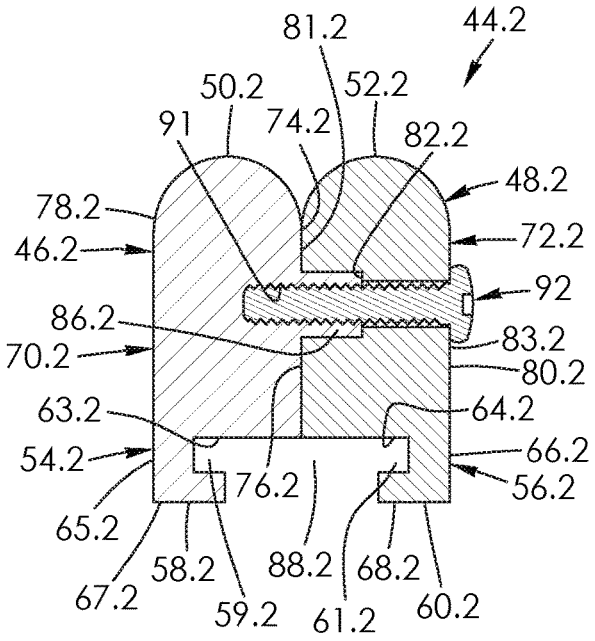
FIG. 6 is a cross-sectional view similar to FIG. 2 of a ring sizing insert according to a third aspect.

FIG. 6 shows a ring sizing insert 44.2 according to a third aspect. Like parts have like numbers and functions as the insert 44 shown in FIGS. 1 to 4 with the addition of decimal extension "0.2". Insert 44.2 is the same as described for insert 44 shown in FIGS. 1 to 4 with the following exceptions.

Elongate member 46.2 includes a threaded recess 91 which extends from inner surface 74.2 of planar portion 70.2 towards outer surface 78.2 of the planar portion. Insert 44.2 includes a fastener, in this example a bolt 92 shaped to extend through elongate member 48.2, be inserted within recess 91 and threadably couple to elongate member 46.2 to further selectively couple the elongate members together.

Figure 7:
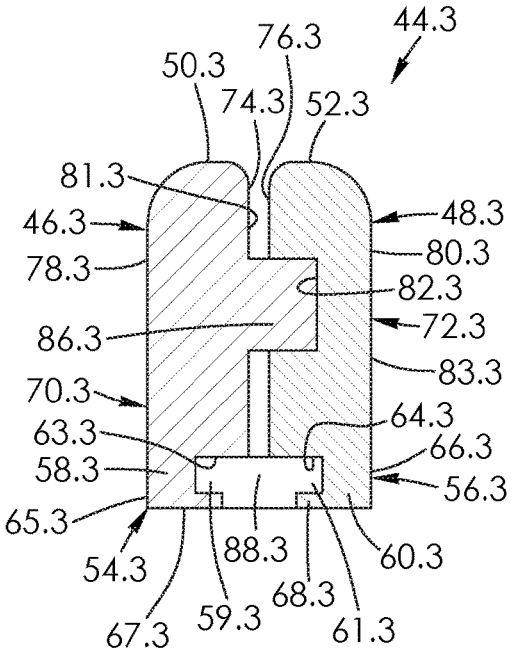
FIG. 7 is a cross-sectional view similar to FIG. 2 of a ring sizing insert according to a fourth aspect.

FIG. 7 shows a ring sizing insert 44.3 according to a fourth aspect. Like parts have like numbers and functions as the insert 44 shown in FIGS. 1 to 4 with the addition of decimal extension "0.3". Insert 44.3 is the same as described for insert 44 shown in FIGS. 1 to 4 with the following exceptions. In this embodiment, the inner surfaces 74.3 and 76.3 of the planar portions 70.3 and 72.3 of the elongate members 46.3 and 48.3 remain spaced-apart from each other when the protrusions 86.3 of elongate member 46.3 fit within the sockets 82.3 of elongate member 48.3. This may result in an insert 44.3 that accommodates rings of greater width, for example.

Figure 8:
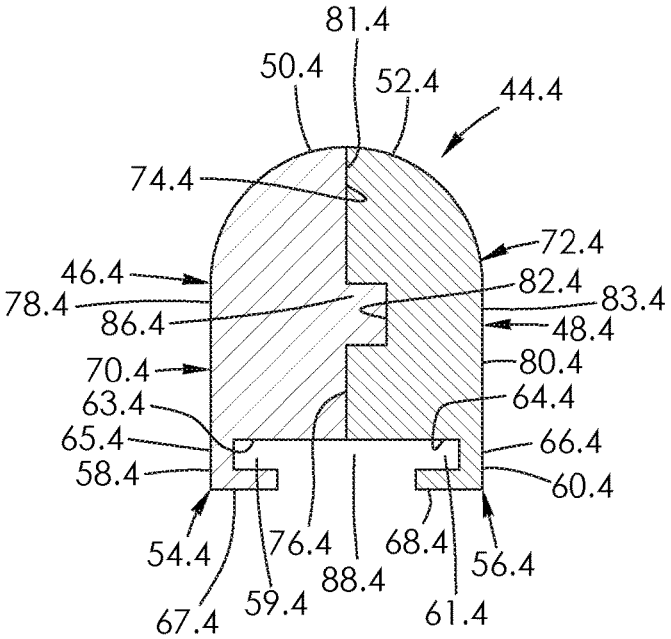
FIG. 8 is a cross-sectional view similar to FIG. 2 of a ring sizing insert according to a fifth aspect.

FIG. 8 shows a ring sizing insert 44.4 according to a fifth aspect. Like parts have like numbers and functions as the insert 44 shown in FIGS. 1 to 4 with the addition of decimal extension "0.4". Insert 44.4 is the same as described for insert 44 shown in FIGS. 1 to 4 with the following exception. The finger-abutting peripheral portions 50.4 and 52.4 of the elongate members 46.4 and 48.4 when coupled together collectively form an arcuate shape in cross-section in this example.

Figure 9:
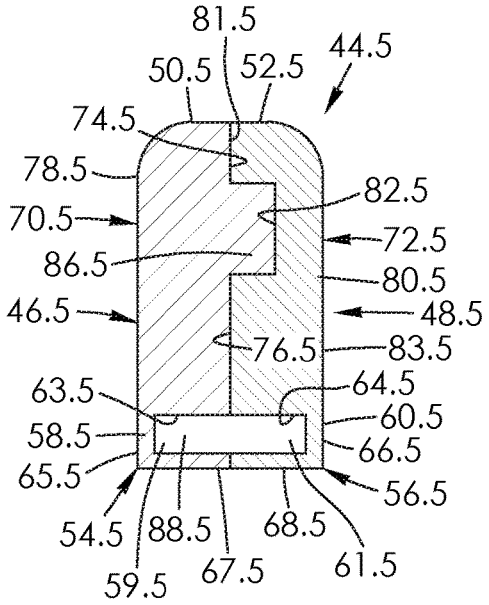
FIG. 9 is a cross-sectional view similar to FIG. 2 of a ring sizing insert according to a sixth aspect.

FIG. 9 shows a ring sizing insert 44.5 according to a sixth aspect. Like parts have like numbers and functions as the insert 44 shown in FIGS. 1 to 4 with the addition of decimal extension "0.5". Insert 44.5 is the same as described for insert 44 shown in FIGS. 1 to 4 with the following exceptions. The outer portions 67.5 and 68.5 of the catches 58.5 and 60.5 are shaped such that the catches fully extend about and enclose a portion of the band of the ring when the elongate members 46.5 and 48.5 are coupled together. Receptacle 88.5 is thus fully enclosed when the elongate members of insert 44.5 are coupled together in this embodiment.

FIGS. 10 to 12 show a ring sizing insert 44.6 according to a seventh aspect. Like parts have like numbers and functions as the insert 44 shown in FIGS. 1 to 4 with the addition of decimal extension "0.6". Insert 44.6 is the same as described for insert 44 shown in FIGS. 1 to 4 with the following exceptions.

Referring to FIG. 10, the outer peripheral portions 56.6 of the elongate members 48.6 generally abut the annular inner surface 27.6 of the ring 20.6. As seen in FIG. 11, elongate member 46.6 includes a pair of circumferentially spaced-apart, radially outwardly-extending catches 58.6 and 93 in this example. As seen in FIG. 12, elongate member 48.6 includes a pair of circumferentially spaced-apart, radially outwardly-extending catches 60.6 and 94. Referring to FIGS. 11 and 12, the portions 63.6, 64.6, 65.6, 66.6, 67.6 and 68.6 of the catches 58.6, 60.6, 93 and 94 are generally rectangular in shape in this example.

FIG. 13 shows a ring sizing insert 44.7 according to an eighth aspect. Like parts have like numbers and functions as the insert 44.6 shown in FIGS. 10 to 12 with decimal extension "0.7" replacing decimal extension "0.6" and being added to like parts not previously having decimal extensions. Insert 44.7 is the same as described for insert 44.6 shown in FIGS. 10 to 12 with the exception that insert 44.7 is configured for a generally square-shaped ring 20.7 with an opening 22.7 that is square-shaped. The elongate members 48.7 and catches 60.7 and 94.7 are thus elongate and generally rectangular in shape in this example, with the catches coupling to and extending outwards in a perpendicular manner from the elongate members.

FIGS. 14 to 19 show a ring sizing insert 44.8 according to a ninth aspect. Like parts have like numbers and functions as the insert 44 shown in FIGS. 1 to 4 with decimal extension "0.8" being added. Insert 44.8 is the same as described for insert 44 shown in FIGS. 1 to 4 with the following exceptions.

Figure 19:
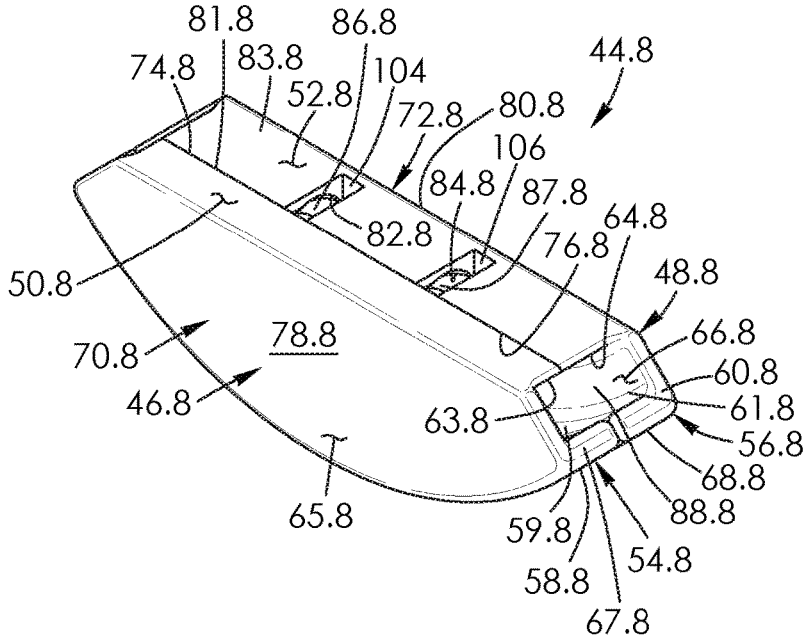
FIG. 19 is a perspective view of the elongate members of the insert of FIG. 18 shown coupled together.

As seen in FIG. 19, inner planar portion 83.8 of elongate member 48.8 extends perpendicularly outwards from outer surface 80.8 of planar portion 72.8 to a greater extent compared to arc-shaped outer portion 68.8 of catch 60.8 in this example. Arc-shaped outer portion 67.8 of catch 58.8 extends outwards from outer surface 78.8 to a greater extent compared to inner planar portion 81.8 of elongate member 46.8 in this embodiment.

Figure 14:
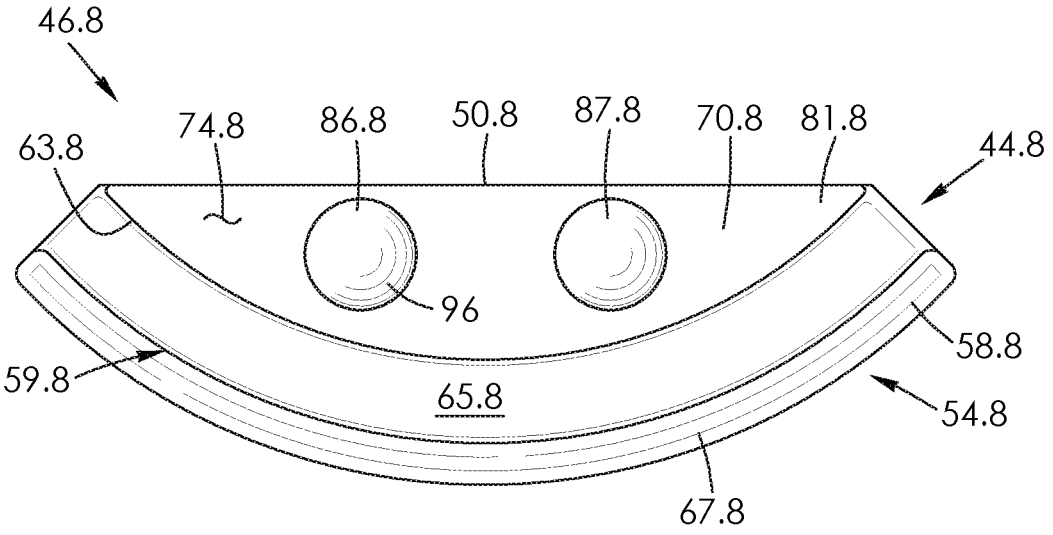
FIG. 14 is an end view of a first of a pair of elongate members of a ring sizing insert according to a ninth aspect.
Figure 16:
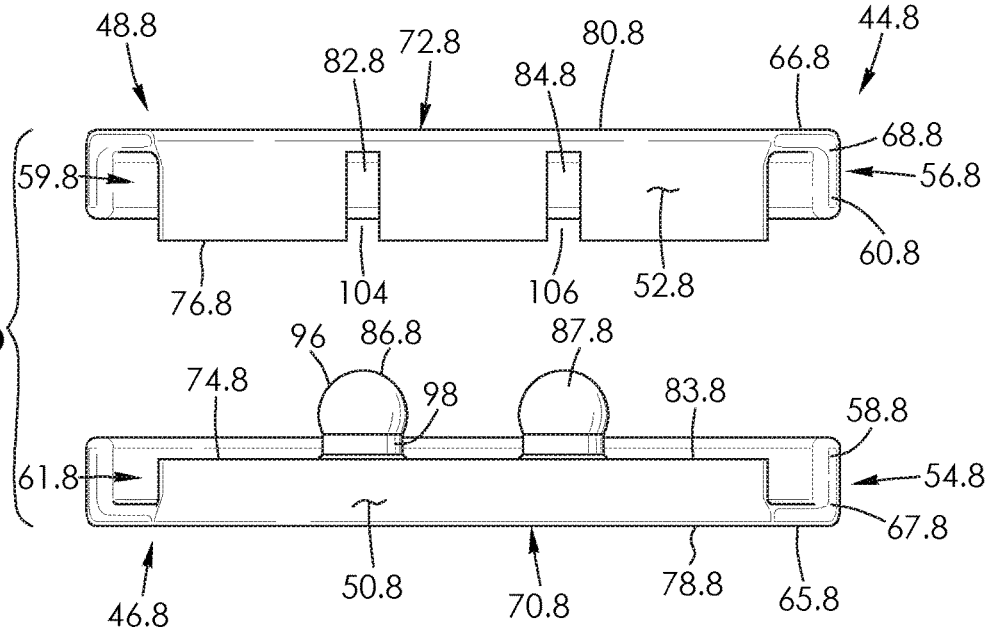
FIG. 16 is an exploded, inner side view of the elongate members of the insert of FIGS. 14 and 15, the members being spaced-apart.
Figure 17:
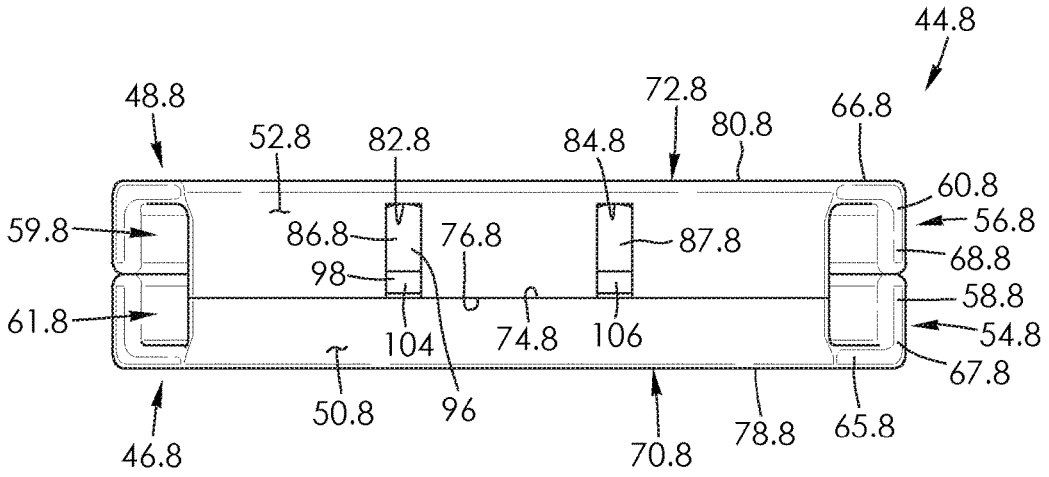
FIG. 17 is an exploded, inner side view of the elongate members of the insert of FIG. 16 shown coupled together.
Figure 18:
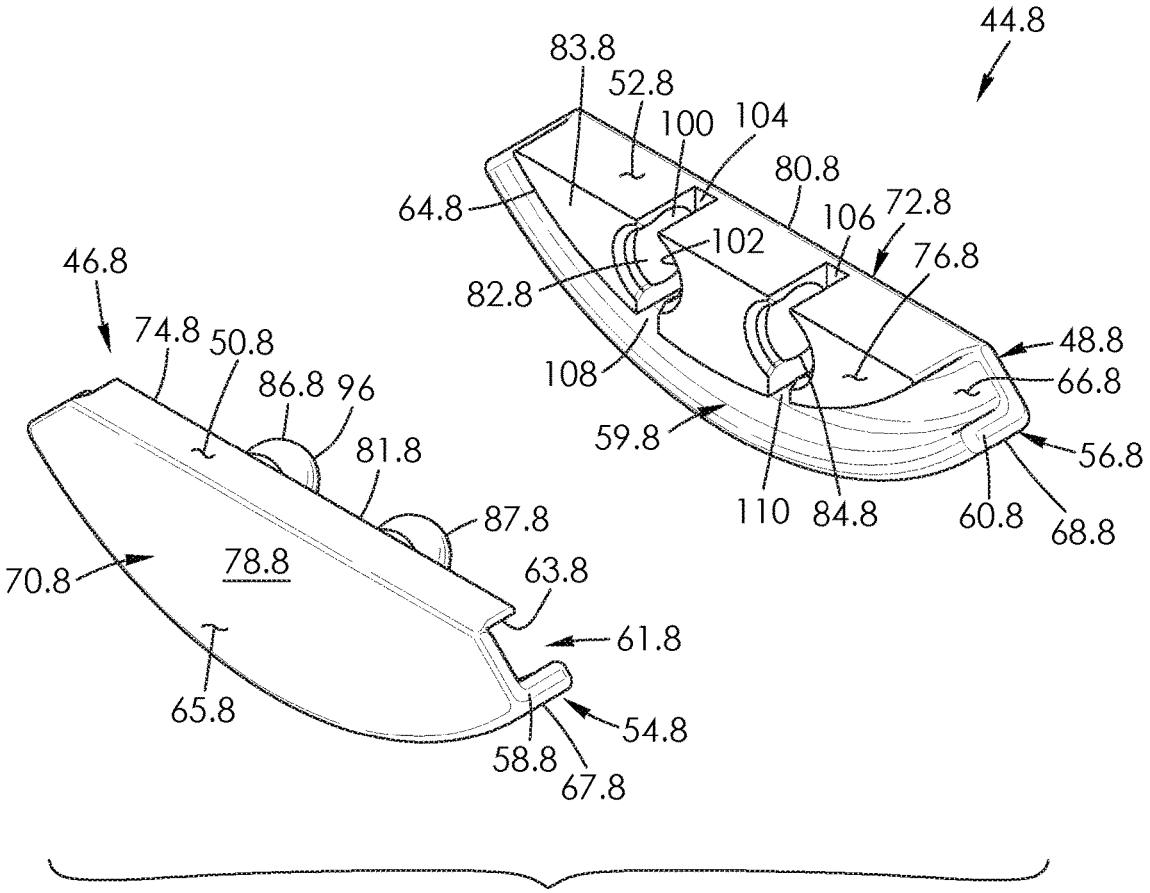
FIG. 18 is a perspective view of the elongate members of the insert of FIG. 16, the members being spaced-apart.

As seen in FIGS. 14 and 16, each of the protrusions 86.8 and 87.8 includes a partially spherical end portion 96 that couples to inner surface 74.8 of the inner planar portion 83.8 of the elongate member 46.8 via a shaft 98. Referring to FIG. 18, sockets 82.8 and 84.8 have partially spherical walls 100 and 102.

Figure 15:
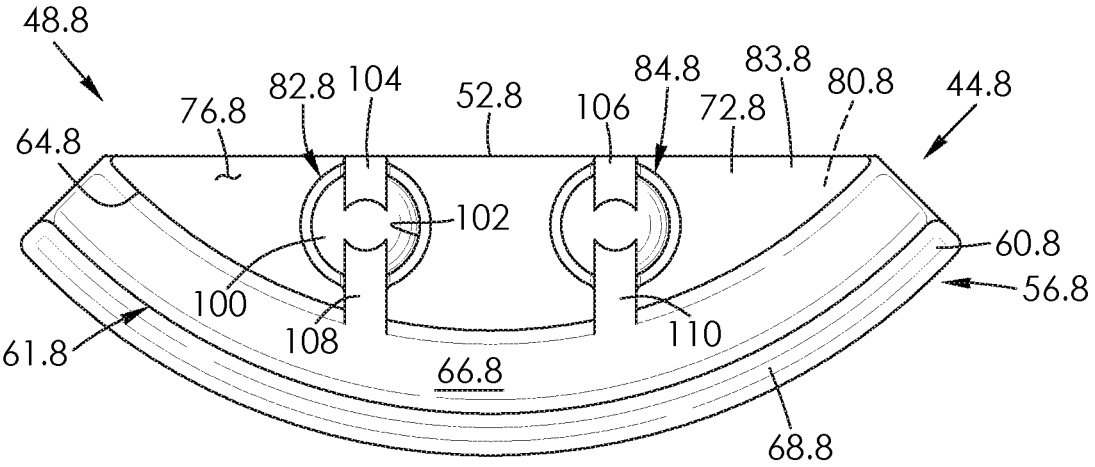
FIG. 15 is an end view of a second of the pair of elongate members of the insert of FIG. 14.

As seen in FIG. 15, a first pair of slots 104 and 106 extends from inner peripheral edge 52.8 of elongate member 48.8 shaped to said sockets 82.8 and 84.8, respectively. Referring to FIG. 16, the slots extend from the inner surface 76.8 of the planar portion 72.8 of the elongate member towards the outer surface 80.8 of the planar portion of the elongate member. As seen in FIG. 15, a second pair of slots 108 and 110 extends from arc-shaped, inner portion 64.8 of catch 60.8 to sockets 82.8 and 84.8. The slots extend from the inner surface 76.8 of the planar portion 72.8 of the elongate member 48.8 towards the outer surface 80.8 of the planar portion of the elongate member. As seen in FIG. 18, slots 100 and 108 align with each other and slots 106 and 110 align with each other in this example.

Figure 20:
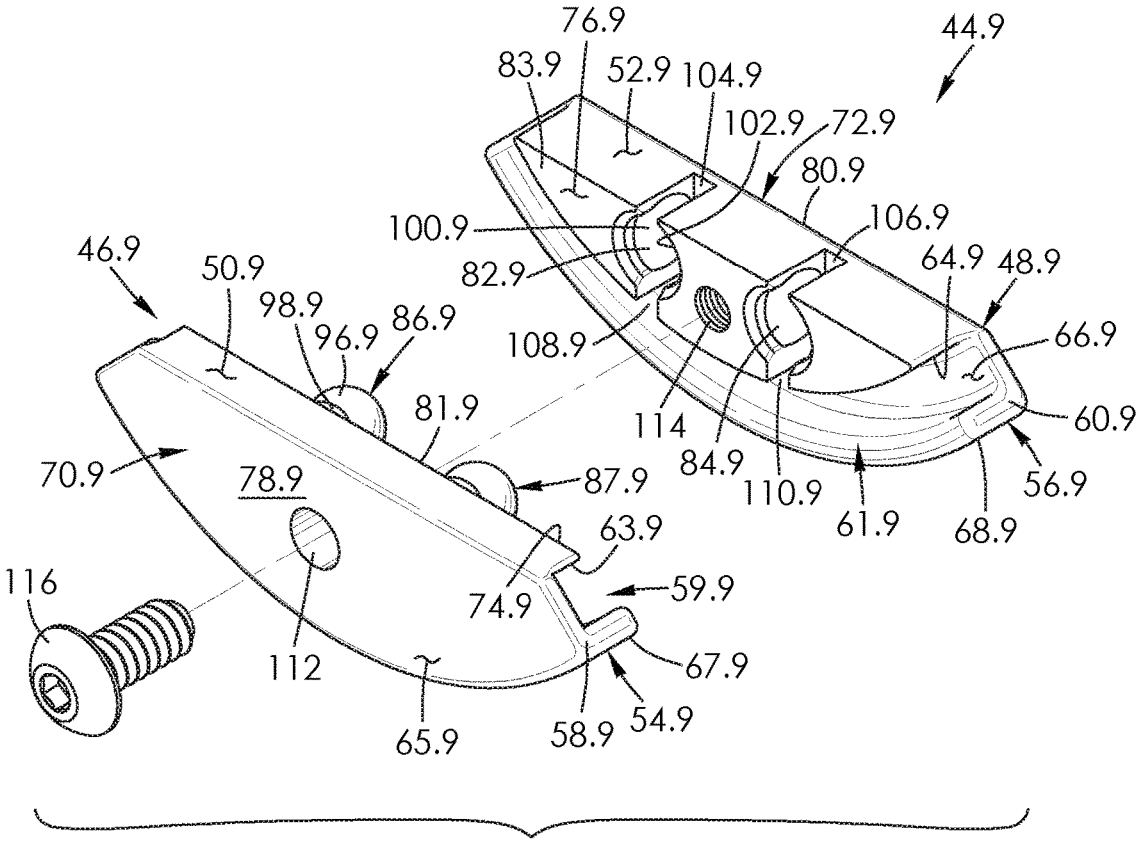
FIG. 20 is an exploded perspective view of a ring sizing insert, the insert being according to a tenth aspect and comprises a bolt and a pair of spaced-apart elongate members.
Figure 21:
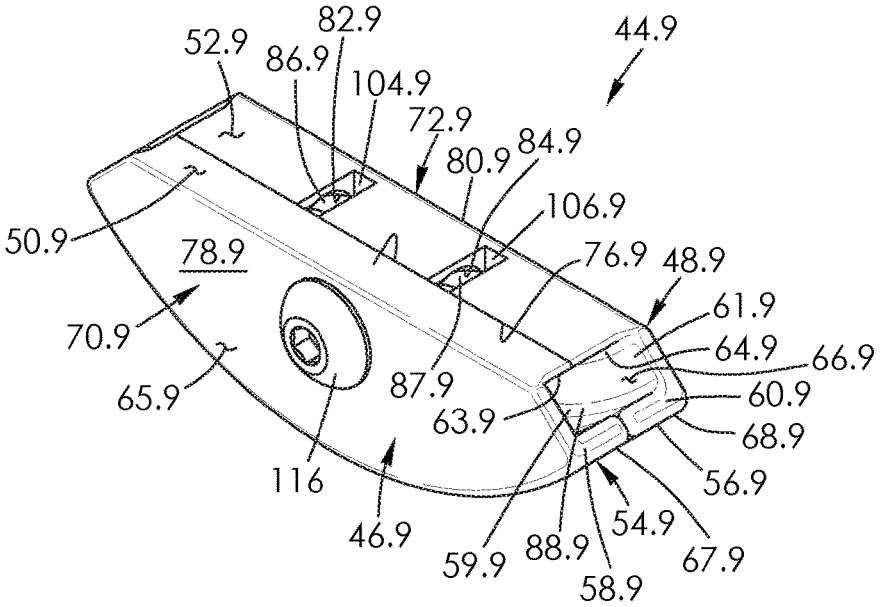
FIG. 21 is a perspective view of the insert of FIG. 20, with the elongate members of the insert being shown coupled together.

FIGS. 20 to 21 show a ring sizing insert 44.9 according to a tenth aspect. Like parts have like numbers and functions as the insert 44.8 shown in FIGS. 14 to 19 with decimal extension "0.9" replacing decimal extension "0.8" and being added for numbers not previously having decimal extensions. Insert 44.9 is the same as described for insert 44.8 shown in FIGS. 14 to 19 with the following exceptions.

Elongate member 46.9 has an aperture 112 extending through the inner planar portion 81.9 thereof, from the outer surface 78.9 to inner surface 74.9 of the planar portion 70.9 thereof. The aperture is positioned between protrusions 86.9 and 87.9 in this example. Elongate member 48.9 has a threaded aperture 114 located on the inner planar portion 83.9 thereof, and extending from the inner surface 76.9 towards outer surface 80.9 of the planar portion 72.9 thereof. The aperture is positioned between sockets 82.9 and 84.9 in this example.

Insert 44.9 includes a fastener, in this example a bolt 116. The bolt is shaped to further couple the elongate members 46.9 and 48.9 together, with the bolt extending through aperture 112 of elongate member 46.9 and threadably engaging with elongate member 48.9 via threaded aperture 114.

Figure 22:
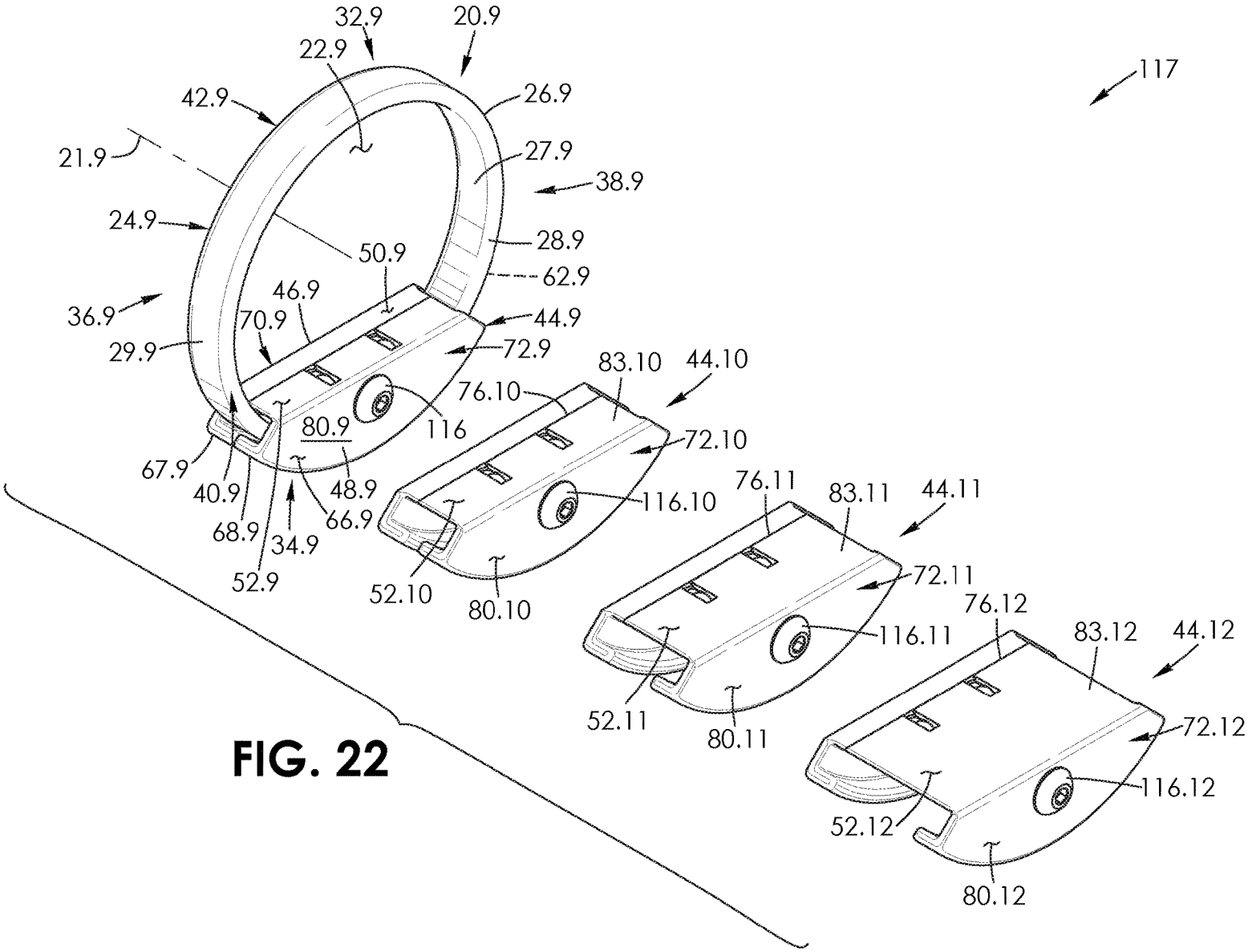
FIG. 22 is a perspective view of the insert of FIG. 21 shown coupled to and extending about a ring, together with a series of additional ring sizing inserts of varying widths according to eleventh, twelfth, and thirteenth aspects to accommodate additional rings of varying widths.
Figure 23:
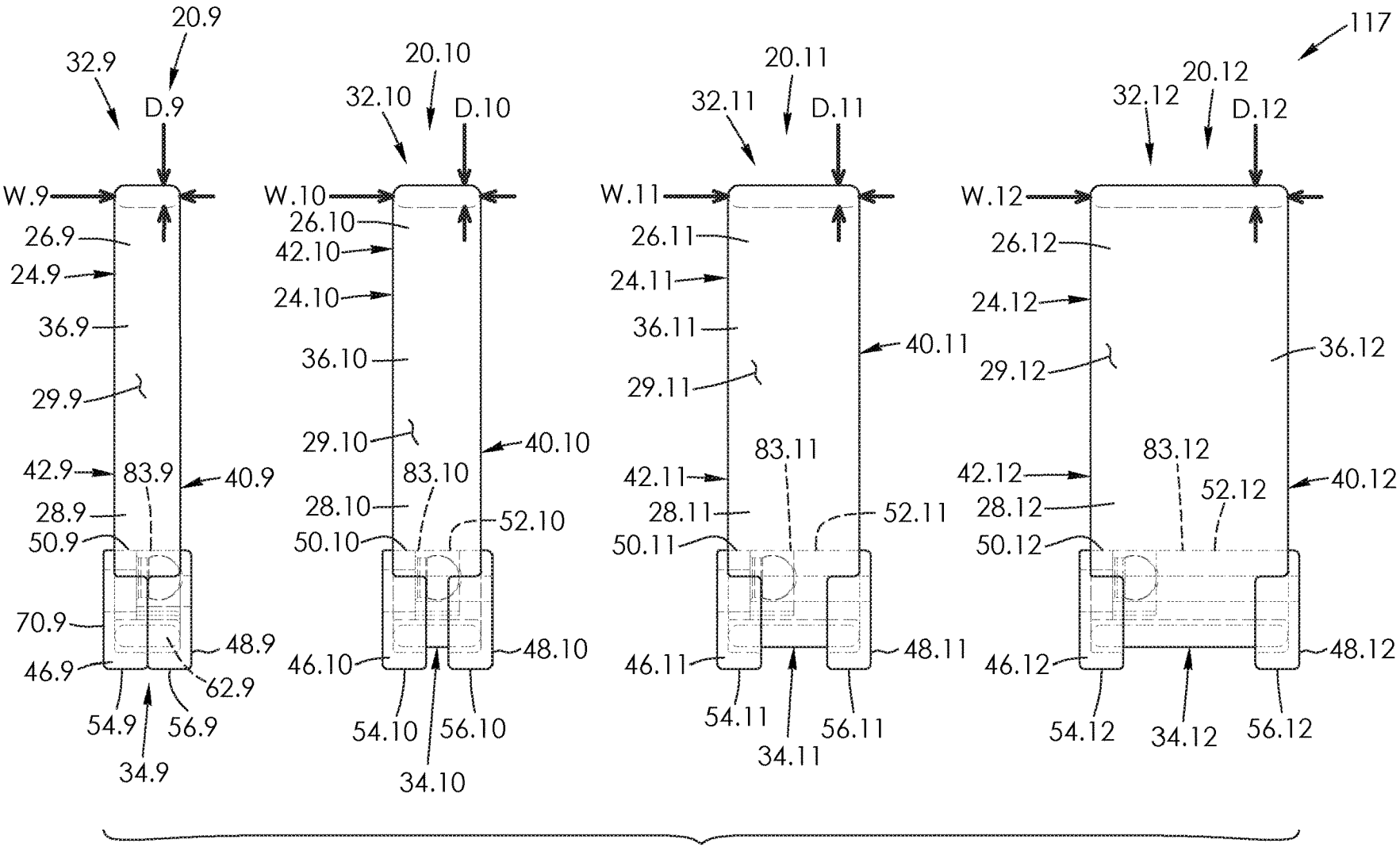
FIG. 23 is a side elevation view of the assemblies of FIG. 22 shown coupled to and extending about rings of varying widths, with the assemblies being shown partially in ghost to reveal inner parts thereof.

FIGS. 22 to 23 show a kit 117 of ring sizing inserts 44.9, 44.10, 44.11 and 44.12 for effectively reducing the ring size of a plurality of rings 20.9, 20.10, 20.11 and 20.12 of varying widths W, W.10, W.11 and W.12 seen in FIG. 23.

Elongate members 46.9, 46.10, 46.11 and 46.12 are substantially the same as each other, with like parts having like numbers and the substitution of an incrementally higher decimal extension number. Elongate members 48.9, 48.10, 48.11 and 48.12 are substantially the same, with like parts having like numbers and the substitution of an incrementally higher decimal extension number, with the following exceptions.

Referring to FIG. 22, inner planar portion 83.10 and inner peripheral edge 52.10 of elongate member 48.10 are larger in a direction extending from the outer surface 80.10 of the planar portion 72.10 to the inner surface 76.10 of the planar portion, compared to the inner planar portion 83.9 and inner peripheral edge 52.9 of elongate member 48.9. As seen in FIG. 23, elongate member 48.10 may thus fit ring 20.10 having a width W.10 that is greater than that of ring 20.9.

As seen in FIG. 22, inner planar portion 83.11 and inner peripheral edge 52.11 of elongate member 48.11 are larger in a direction extending from the outer surface 80.11 of the planar portion 72.11 to the inner surface 76.11 of the planar portion, compared to the inner planar portion 83.10 and inner peripheral edge 52.10 of elongate member 48.10. As seen in FIG. 23, elongate member 48.11 may thus fit ring 20.11 having a width W.11 that is greater than that of ring 20.10.

Referring to FIG. 22, inner planar portion 83.12 and inner peripheral edge 52.12 of elongate member 48.12 are larger in a direction extending from the outer surface 80.12 of the planar portion 72.12 to the inner surface 76.12 of the planar portion, compared to the inner planar portion 83.11 and inner peripheral edge 52.11 of elongate member 48.11. As seen in FIG. 23, elongate member 48.12 may thus fit ring 20.12 having a width W.12 that is greater than that of ring 20.11.

Figure 24:
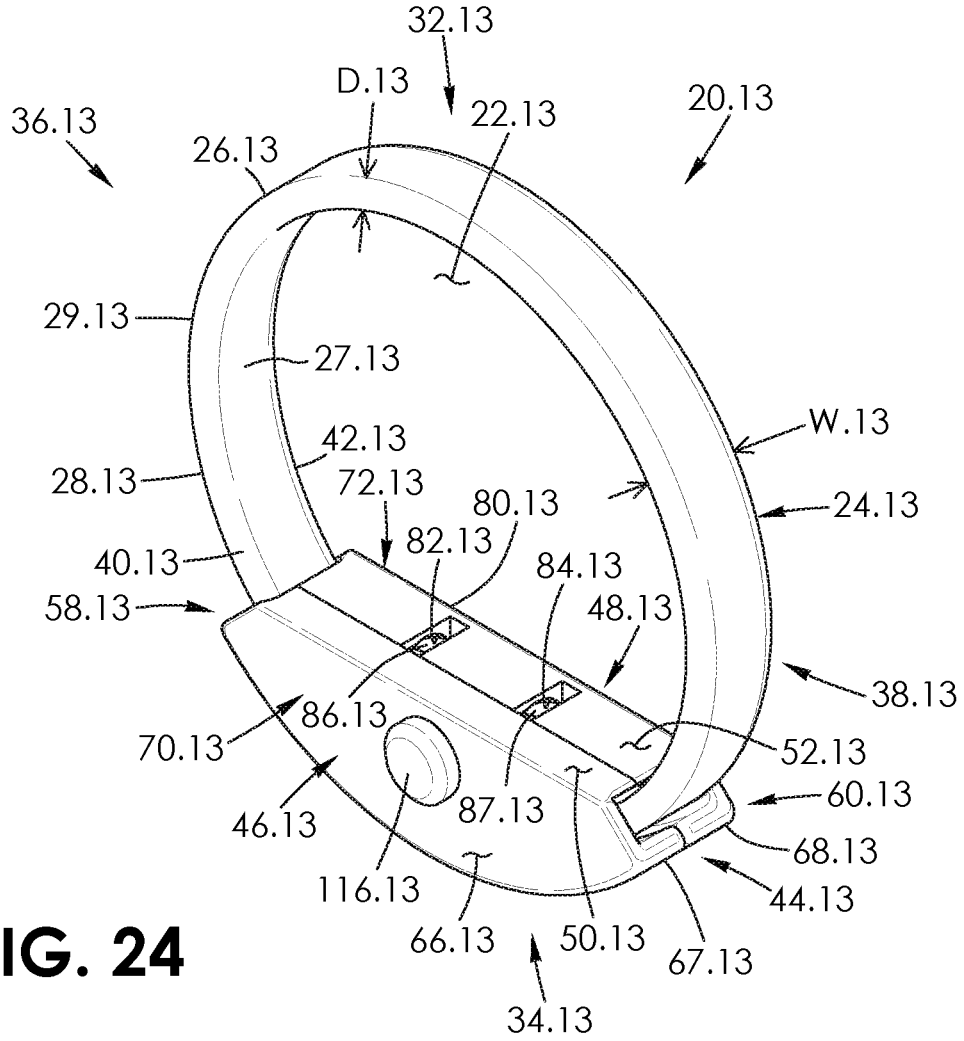
FIG. 24 is a perspective view of a ring sizing insert according to a fourteenth aspect, the insert including a rivet and being shown coupled to and extending about a ring.
Figure 25:
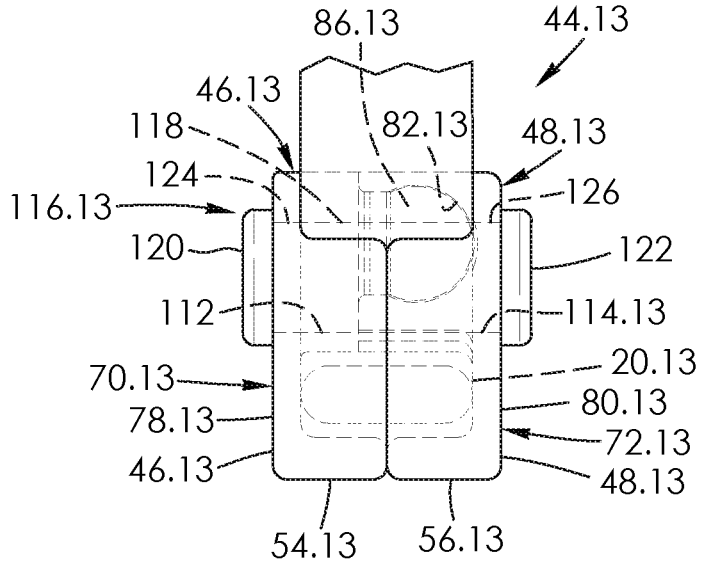
FIG. 25 is a sectional view of the insert and ring of FIG. 24, with the insert being shown partially in ghost to reveal inner parts thereof and the ring.

FIGS. 24 to 25 show a ring sizing insert 44.13 according to a fourteenth aspect. Like parts have like numbers and functions as the insert 44.9 shown in FIGS. 20 to 21 with decimal extension "0.13" replacing decimal extension "0.9" and being added for numbers not previously having decimal extensions. Insert 44.13 is the same as described for insert 44.9 shown in FIGS. 20 to 21 with the exception that the insert includes a fastener in the form of a rivet 116.13. The elongate members 46.13 and 48.13 are thus further riveted together via said rivet.

As seen in FIG. 25, the rivet 116.13 includes an elongate portion, in this example a shaft 118 which extends through apertures 112.13 and 114.13 of elongate members 46.13 and 48.13, respectively. The rivet has a pair of spaced-apart protuberances 120 and 122 which couple to and extend radially outwards from opposite ends 124 and 126 of the shaft. The protuberances abut outer surfaces 78.13 and 80.13 of the planar portions 70.13 and 72.13 of the elongate members 46.13 and 48.13 after the protrusions 86.13 and 87.13 of elongate member 46.13, seen in FIG. 24, are received within sockets 82.13 and 84.13 of elongate member 48.13. The rivet 116.13 functions to inhibit separation of the elongate members thereby.

Figure 26:
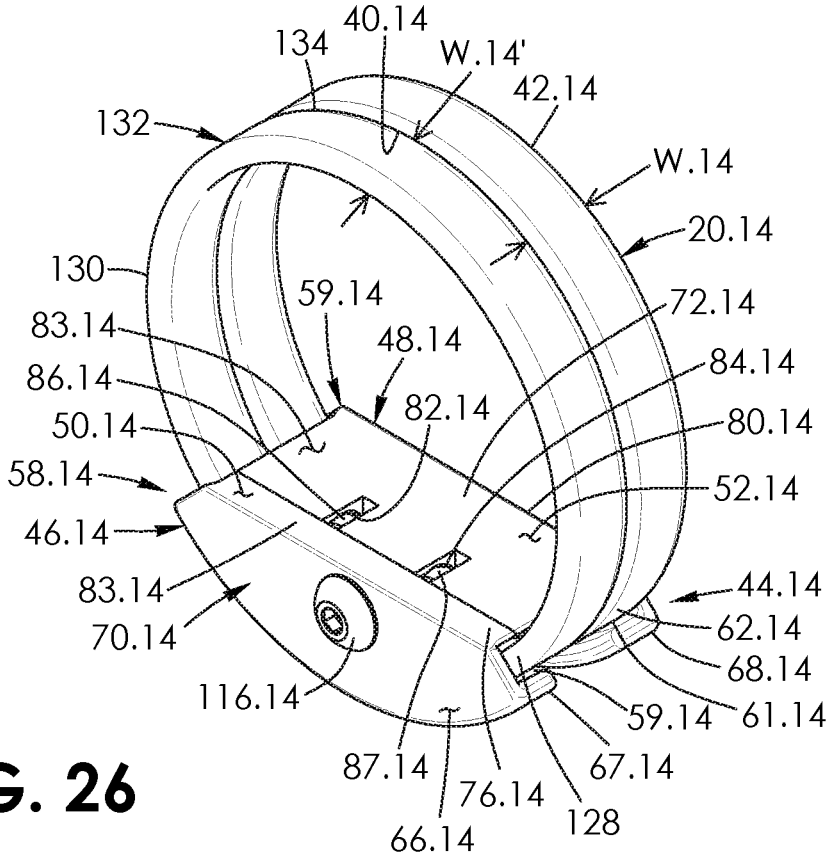
FIG. 26 is a perspective view of a ring sizing insert according to a fifteenth aspect, the insert functioning as a ring coupler and being shown coupling together a pair of rings.
Figure 27:
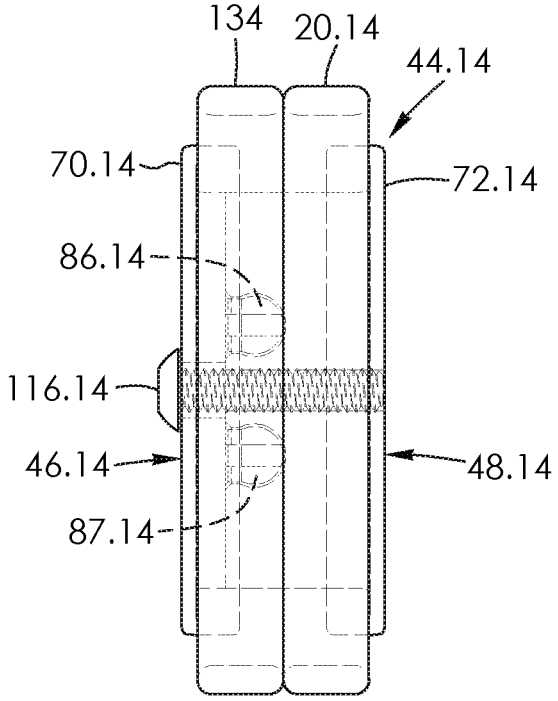
FIG. 27 is a top view partially in ghost of the insert and rings of FIG. 26.

FIGS. 26 to 27 show a ring sizing insert in this example a ring coupler 44.14 according to a fifteenth aspect. Like parts have like numbers and functions as the insert 44.9 shown in FIGS. 20 to 21 with decimal extension "0.14" replacing decimal extension "0.9" and being added for numbers not previously having decimal extensions. Coupler 44.14 is the same as described for insert 44.9 shown in FIGS. 20 to 21 with the following exceptions.

Referring to FIG. 26, channel 59.14 of elongate member 46.14 is shaped to receive and extend along a portion 128 of a first annular end 130 of a first ring 132. The second annular end 134 of the first ring abuts the first annular end 40.14 of a second ring 20.14. Channel 61.14 of elongate member 48.14 is shaped to receive and extend along portion 62.14 of annular end 42.14 of the second ring. The elongate members 46.14 and 48.14 are selectively connectable together for coupling together the rings 132 and 20.14, and are further shaped to partially extend within the opening of the rings.

Inner planar portion 83.14 and inner peripheral edge 52.14 of elongate member 48.14 are larger in a direction extending from the outer surface 80.14 of the planar portion 72.14 to the inner surface 76.14 of the planar portion, compared to the inner planar portion 83.14 and inner peripheral edge 52.14 of elongate member 48.14. Inner planar portion 83.14 and inner peripheral edge 52.14 of elongate member 48.14 extend across the width W.14 of ring 20.14 and partially across the width W.14' of ring 132 in this example.

It will be appreciated that many variations are possible within the scope of the invention described herein. For kit 117 seen in FIGS. 22 and 23, instead of elongate members 46.9, 46.10, 46.11 and 46.12, the kit may comprise only elongate member 46.9, for example. It will also be understood by someone skilled in the art that many of the details provided above are by way of example only and are not intended to limit the scope of the invention which is to be determined with reference to at least the following claims.

What is claimed is:

1. A ring sizing insert comprising:

a pair of elongate members each of which is shaped to partially extend within an opening of a ring, each of the elongate members including an outer peripheral portion that is arcuate-shaped in side profile and C-shaped in cross-section, the outer peripheral portions of the elongate members together forming a receptacle, each of the elongate members including an inner planar portion that is a circular segment in side profile in a region spanning the opening of the ring, the inner planar portions of the elongate members having inner edges that are straight and chord-like and which extend perpendicular to the axis of the ring, the inner edges of the inner planar portions of the elongate members extending across and spanning said outer peripheral portions of the elongate members, a first of the elongate members so shaped including a protrusion outwardly extending from the inner planer portion thereof, the inner planar portion of a second of the elongate members so shaped having a recess shaped to selectively receive the protrusion, the inner planar portion of the second of the elongate members having a pair of slots, each of which extends radially outwards from diametrically opposed sides of said recess, and the elongate members when coupled together forming said receptacle which receives a portion of the ring.

2. The insert as claimed in claim 1 wherein the elongate members are rigid and shaped to interference fit together.

3. The insert as claimed in claim 1 wherein the insert includes a fastener shaped to further selectively couple together the elongate members.

4. The insert as claimed in claim 1 wherein each of the elongate members includes an arcuate-shaped peripheral portion shaped to abut an annular inner surface of the ring.

5. The insert as claimed in claim 1 wherein each of the elongate members includes at least one catch shaped to at least partially extend about a said portion of the ring, with each said catch including a first portion which extends across a depth of the ring and a second portion which extends across part of and in the direction of a width of the ring.

6. The insert as claimed in claim 5 wherein the portions of the catches are arcuate.

7. The insert as claimed in claim 1 wherein each said elongate member has an arc-shaped lateral portion which couples to the inner planar portion thereof and which extends across a depth of the ring, wherein each said elongate member has an arc-shaped outer portion which couples to the lateral portion thereof and which extends across part of and in the direction of a width of the ring, and wherein the elongate members include channels formed by said inner planar portions, said lateral portions and said outer portions of the elongate members.

8. The insert as claimed in claim 1 wherein the first of the elongate members includes a first said protrusion and a second said protrusion each coupled to and extending outwards from the inner planar portion thereof, wherein the second of the elongate members has a first said recess and a second said recess shaped to receive and couple with respective said protrusions, and wherein the insert includes a fastener positioned between the protrusions and the recesses and which is configured to further couple together the elongate members.

9. The ring sizing insert as claimed in claim 1 for use as a ring coupler, with a channel of the first of the elongate members being shaped to receive and extend along a portion of an annular end of a first ring and a channel of the second of the elongate members being shaped to receive and extend along a portion of an annular end of a second ring.

10. In combination, a pair of rings and the ring sizing insert as claimed in claim 9.

11. A kit comprising the ring sizing insert of claim 1, wherein the first of the elongate members has a channel shaped to receive and extend along a portion of an annular end of a first ring or a second ring, the first ring having a width and the second ring having a width that is larger than the width of the first ring, wherein the second of the elongate members has a channel shaped to receive and extend along the portion of the annular end of the first ring, and wherein the kit further comprises a third elongate member including a channel which is shaped to receive and extend along a portion of the annular end of the second ring, the channel of the third elongate member being deeper than the channel of the second of the elongate members, the first of the elongate members and the second of the elongate members being selectively connectable together and shaped to partially extend within the opening of the first ring, and the first of the elongate members and the third elongate member being selectively connectable together and shaped to partially extend within the opening of the second ring.

12. The insert as claimed in claim 1 wherein one said slot extends from said inner edge of the inner planar portion of the second of the elongate members to said recess.

13. The insert as claimed in claim 1, wherein the slots extend from an inner surface of the inner planar portion of the second of the elongate members towards an outer surface of the inner planar portion of the second of the elongate members.

14. The insert as claimed in claim 1, wherein a first said slot aligns with a second said slot.

15. The insert as claimed in claim 1, wherein said protrusion includes an at least partially spherical end portion, and wherein wherein the recess comprises a socket shaped to selectively receive the protrusion.

16. The insert as claimed in claim 15 wherein the socket has partially spherical walls.

17. The ring sizing insert of claim 1 wherein the inner planar portion of the second of the elongate members has an inner surface and an outer surface, and wherein the recess which extends from adjacent the inner surface thereof to adjacent the outer surface thereof.

18. In combination, a ring and the ring sizing insert as claimed in claim 1.

* * * * *